US009108072B2

(12) United States Patent
Jie et al.

(10) Patent No.: US 9,108,072 B2
(45) Date of Patent: Aug. 18, 2015

(54) BUILDING FIRE ESCAPE SYSTEM AND REFUGE CHAMBER

(75) Inventors: Baoru Jie, Nanchang (CN); Jiangang Jie, Nanchang (CN)

(73) Assignee: Jiangxi Province Fenghe Yingzao Group Co., Ltd.

( * ) Notice: Subject to any disclaimer, the term of this patent is extended or adjusted under 35 U.S.C. 154(b) by 0 days.

(21) Appl. No.: 13/984,696

(22) PCT Filed: Feb. 13, 2012

(86) PCT No.: PCT/CN2012/071087

§ 371 (c)(1),
(2), (4) Date: Feb. 13, 2014

(87) PCT Pub. No.: WO2012/107005

PCT Pub. Date: Aug. 16, 2012

(65) Prior Publication Data

US 2014/0196383 A1 Jul. 17, 2014

(30) Foreign Application Priority Data

Feb. 11, 2011 (CN) ..... 2011 1 0036081

(51) Int. Cl.

| | |
|---|---|
| ***A62B 3/00*** | (2006.01) |
| ***A62B 1/20*** | (2006.01) |
| ***A62B 5/00*** | (2006.01) |

(Continued)

(52) U.S. Cl.

CPC ... *A62B 1/20* (2013.01); *A62B 5/00* (2013.01); *A62C 2/08* (2013.01); *A62C 35/15* (2013.01); *E04B 1/94* (2013.01); *E04H 1/04* (2013.01)

(58) Field of Classification Search

CPC ..... A62B 1/20; A62B 3/00
USPC ..... 182/48, 49, 100, 129, 138, 139, 4, 9; 52/168

See application file for complete search history.

(56) References Cited

U.S. PATENT DOCUMENTS 3,915,258 A 10/1975 Nusslein
4,768,619 A * 9/1988 Darnell ..... 182/129

(Continued)

FOREIGN PATENT DOCUMENTS

CN 2606600 Y 3/2004
CN 2617404 Y 5/2004

(Continued)

*Primary Examiner* — William Gilbert
(74) *Attorney, Agent, or Firm* — Gifford, Krass, Sprinkle, Anderson & Citkowski, P.C.

(57) ABSTRACT

A building fire escape system, comprising an auxiliary descending device, the auxiliary descending device being a sliding pole (6) or a spiral chute (6'), and at least one refuge chamber, the refuge chamber being a fireproof spatial structure integrated with the building. The inside of the refuge chamber is divided into a first space (2) and a second space (3) by fire partitions (1, 4). The first space (2) communicates with the interior space of the building. The second space (3) communicates with the exterior space of the building. The fire partition (4) is provided with a fireproof door (11) connecting the first space with the second space. Any two neighboring refuge chambers are interconnected. The fire partition is provided with an observation window (12). The first space and the second space are provided with an air supply pipe (14) and an air exhaust pipe (15). Disposed at the top of the refuge chamber is a water tank (16) connected to the fire main pipe (17). Drencher devices (9) are disposed in the first space.

7 Claims, 8 Drawing Sheets

(51) Int. Cl.

| | |
|---|---|
| ***A62C 35/15*** | (2006.01) |
| ***E04B 1/94*** | (2006.01) |
| ***A62C 2/08*** | (2006.01) |
| *E04H 1/04* | (2006.01) |

(56) References Cited

U.S. PATENT DOCUMENTS

| | | | | |
|---|---|---|---|---|
| 5,143,172 | A | 9/1992 | Rhoads | |
| 5,377,778 | A | 1/1995 | Lan | |
| 2002/0104710 | A1* | 8/2002 | Thompson et al. | 182/138 |
| 2008/0142297 | A1* | 6/2008 | Desrosiers | 182/48 |

FOREIGN PATENT DOCUMENTS

| | | | |
|---|---|---|---|
| CN | 1715595 | A | 1/2006 |
| CN | 201963012 | U | 9/2011 |
| JP | 2002035154 | A | 2/2002 |
| KR | 20050026940 | A | 3/2005 |

* cited by examiner

BUILDING FIRE ESCAPE SYSTEM AND REFUGE CHAMBER

FIELD OF THE INVENTION

The present invention relates to a building fire safety facility and more particularly to a building fire escape system and a refuge chamber.

DESCRIPTION OF THE PRIOR ART

Building fire safety is an important issue relating to people's lives and properties, and although regulated and inspected under regulations and rules by governments at all levels, fire disasters still happen sometimes. Particularly, fires that take place at high-rise buildings may cause severe casualties. At the initial moment when a building fire breaks out, within the brief moment before the fire brigade could rush to the scene, it is firstly important to quickly guide the evacuation of the indoor individuals, if the fire cannot be put out by persons onsite, to take refuge waiting for rescue, or to make self-rescue. Unfortunately many casualties take place along the way of escape, due to being obstructed in the fire escape of modern buildings, or being blocked by the fire and poisonous smoke.

SUMMARY OF THE INVENTION

In view of the above defects residing in the prior art, the present invention provides, in one respect, a building fire escape system, and in another respect, a building fire refuge chamber, which are provided for individuals to escape quickly from a building or to take temporary refuge waiting for rescue in case of a fire or an earthquake etc. takes place.

The present invention provides a building fire escape system, comprising an auxiliary descending device, which can be used for escapers to quickly descend from the building to evacuate if a fire takes place.

In a further embodiment, the auxiliary descending device enables the escapers to descend with gravity.

In a further embodiment, the auxiliary descending device is a sliding pole.

In a further embodiment, a cushioning device is disposed at the bottom of the sliding pole.

In a further embodiment, the cushioning device is a metal wire mesh affixed to a metal framework.

In a further embodiment, the upper end of the sliding pole is provided with a safety rope and a rope hook.

In another embodiment, the auxiliary descending device is a chute.

In a further embodiment, the chute is spiral shaped.

In a further embodiment, the auxiliary descending device extends straight through along the height direction of the building.

In a further embodiment, the system further comprises at least one refuge chamber, the escaper utilizing the auxiliary descending device to evacuate to the refuge chamber or to evacuate from the refuge chamber. When a fire happens, the escapers quickly evacuate to the closest refuge chamber and leave by quick auxiliary sliding device, and when there is a plurality of refuge chambers, the escapers can transfer to the refuge chambers located on the lower floors to avoid the risk possibly from a long distance of straight downward sliding.

In a further embodiment, the refuge chamber is provided on each floor of the building.

In a further embodiment, the auxiliary descending devices of the two neighboring refuge chambers are staggered in vertical direction, so that the risk of physical collisions is avoided during the escapers' descending process.

In a further embodiment, the refuge chamber is a fireproof spatial structure integrated with the building, the interior of the refuge chamber is divided by a fire partition into a first space and a second space, the first space communicates with the interior space of the building, the second space communicates with the exterior space of the building, the fire partition is provided with a fire door communicating the first space with the second space, any two neighboring refuge chambers are also communicated with each other.

In a further embodiment, the fireproof spatial structure is of a reinforced concrete frame structure or a steel structure.

In a further embodiment, at least a part of the second space is protruding to the outside of the outer wall of the building.

In a further embodiment, an observation window is provided on the fire partition.

In a further embodiment, the first space and the second space are both provided with an air supply pipe and an air exhaust pipe.

In a further embodiment, the first space is provided with a first fire door leading to the interior space of the building, a water curtain is provided above the first fire door.

In a further embodiment, drencher devices are provided inside the first space.

In a further embodiment, a water tank connected to a fire main pipe is provided on the top of the refuge chamber.

In a further embodiment, the water tank is connected to a water outlet pipe having a gate valve, the water outlet pipe being provided with a hydrant connectable with a fire gun hose.

In a further embodiment, any neighboring the refuge chambers are interconnected with each other through an evacuation exit equipped with a fireproof cover plate.

In a further embodiment, the fireproof cover plate is a two-leaf, upwardly flippable steel plate.

The present invention also provides a building having a building fire escape system as mentioned above.

The present invention also provides, in another respect, a building fire refuge chamber, the refuge chamber is a fireproof spatial structure integrated with the building, the interior of the refuge chamber is divided by a fire partition into a first space and a second space, the first space may be communicated with the interior space of the building, the second space may be communicated with the exterior space of the building, the fire partition is provided with a fire door that may connect the first space with the second space.

In a preferred embodiment of the present invention, the fireproof spatial structure is of a reinforced concrete frame structure or a steel structure.

In a further embodiment, at least a part of the second space is protruding to the outside of the outer wall of the building.

In a further embodiment, an observation window is provided on the fire partition.

In a further embodiment, the first space and the second space are both provided with an air supply pipe and an air exhaust pipe.

In a further embodiment, a water tank is provided on the top of the refuge chamber, a water inlet pipe of the water tank being connected to a fire main pipe.

In a further embodiment, the water tank is connected to a water outlet pipe having a gate valve, the water outlet pipe being provided with a hydrant connectable with a fire gun hose.

In a further embodiment, the first space is provided with a first fire door leading to the interior space of the building, a water curtains provided above the first fire door.

In a further embodiment, drencher devices are provided inside the first space.

The present invention also provides a building having a building fire escape system as mentioned above.

The main beneficial effects of the present invention are as follows:

1. The elevator cannot be used during a fire disaster, whereas by utilizing the building fire escape system, those trapped individuals can quickly escape from the building in a speed much quicker than using a fire escape. When there are refuge chambers provided, the escapers can also evacuate to the refuge chambers on the floors that are not affected or minorly affected by the fire, waiting for external rescue, so as to further guarantee the safety of the escapers by providing precious time for rescue.

2. The refuge chamber of the present invention is an independent reinforced concrete frame structure or a steel structure integrated with the building, which is not easily affected by fire behavior of the main body of the building or earthquake etc. resulting in being blocked or destroyed.

3. The refuge chamber of the present invention is provided with a first space for isolation of fire behavior and prevention of toxic gas, and a second space for waiting for external rescue, comprising first grade fire-proof walls, fire doors, fire-proof floors, water curtains, drenchers, and air supply pipes etc., which can greatly avoid and reduce casualties.

In conclusion, the building fire escape system and fire refuge chamber provided by the present invention can effectively reduce casualties in case of a fire takes place in the building.

Hereinafter more detailed description will be made by incorporating figures to illustrate the conception, structure and technical effect of the present invention for a better understanding of the object, features and effects of the present invention.

DETAILED DESCRIPTION OF THE PREFERRED EMBODIMENTS

Figure 1:
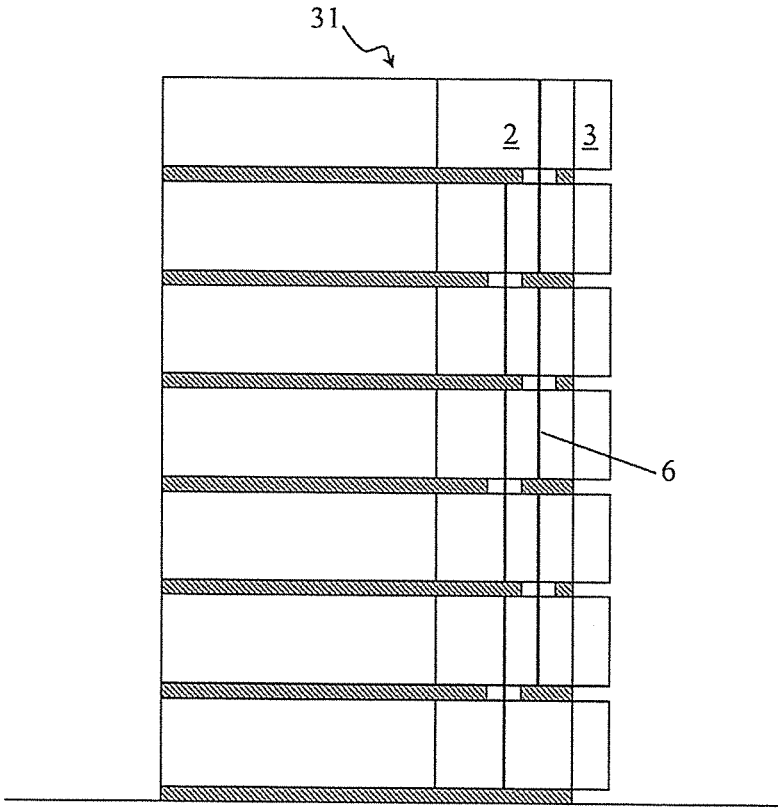
FIG. 1 is a schematic view of an embodiment of a fire escape system according to the present invention.

FIG. 1 illustrates a simple embodiment of the fire escape system of the present invention, wherein building 31 includes a fire escape system comprising an auxiliary descending device, shown in FIG. 1. The auxiliary descending device is a sliding pole 6 that can be clung by the escaper to slide down. In other embodiments, the auxiliary descending device also can be a chute 6' disposed in a spiral shape, shown in FIG. 2, the escapers being able to sit into the chute 6' and spirally sliding down. In these embodiments, the auxiliary descending device mainly utilizes the own gravity of the escaper other than external power such as electricity to descend, because those external power would often become unavailable or unreliable in a fire, while utilizing the escaper's own gravity to descend is the most reliable way. The auxiliary descending device of the present invention, comparing with evacuating through a fire escape, greatly increase the evacuation speed which is vitally important to avoid and reduce casualties when a fire takes place in a building.

Figure 2:
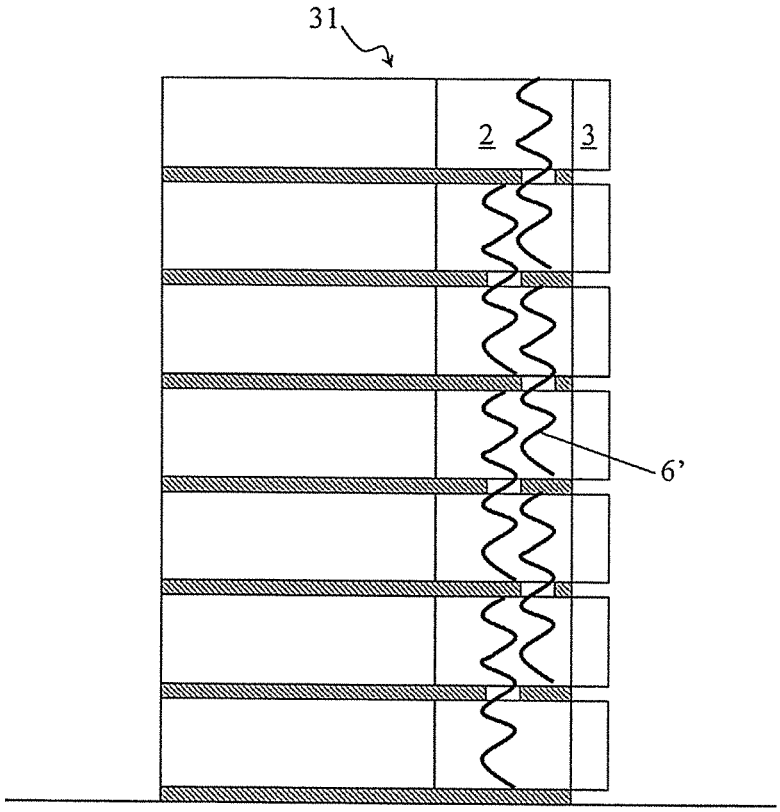
FIG. 2 is a schematic view of another embodiment of a fire escape system according to the present invention.

Moreover, in one embodiment, the system provides refuge chambers on each floor, thus in one respect, the escaper can quickly evacuate to the closest refuge chamber and leave by quick auxiliary descending device; and in another respect, the auxiliary descending devices are staggered in vertical direction, the escapers can transfer between the refuge chambers to reduce the risk from a long distance of straight downward sliding, shown in FIGS. 1 and 2. Under some circumstances, the escapers can evacuate to the refuge chambers on the floors that are not affected by the fire, then waiting for external rescue.

Figure 3:
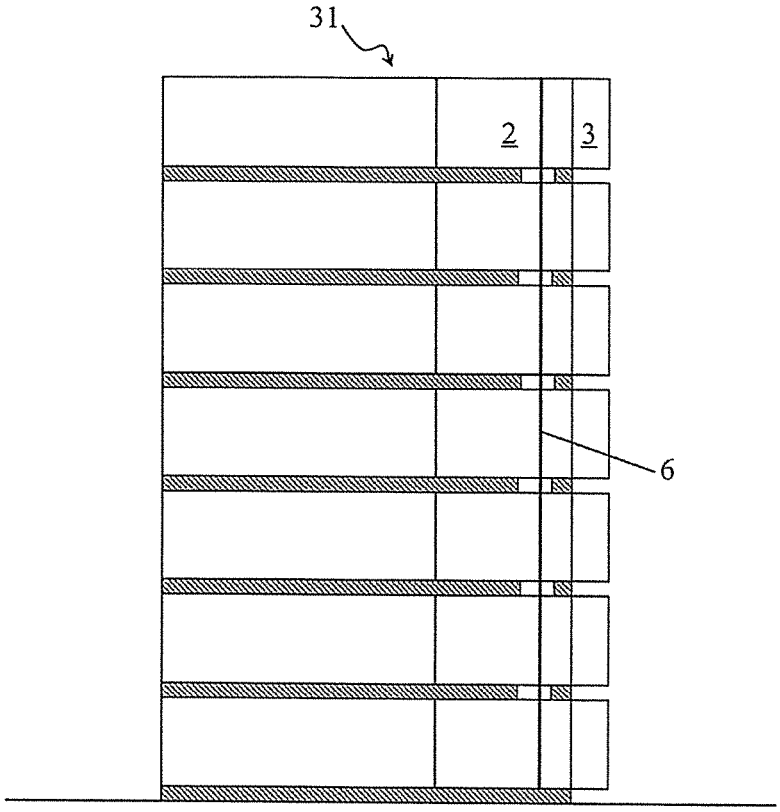
FIG. 3 is a schematic view of another embodiment of a fire escape system according to the present invention.
Figure 4:
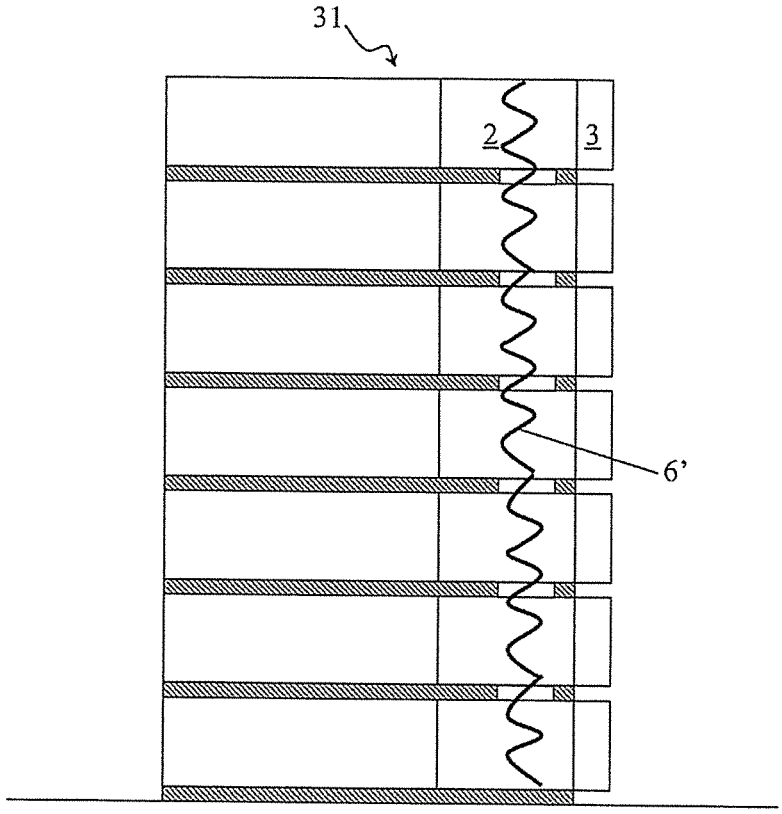
FIG. 4 is a schematic view of another embodiment of a fire escape system according to the present invention.

In addition, under the circumstances where the building is low-rise or safety can be guaranteed during other quick descending process, the aforementioned auxiliary descending device may also be set up straight throughout the building along the height thereof, shown in FIGS. 3 and 4, which is to say, then, the escapers can descend by utilizing the auxiliary descending device from the floor they are on to directly reach the ground floor of the building without stay and/or transfer.

Figure 5:
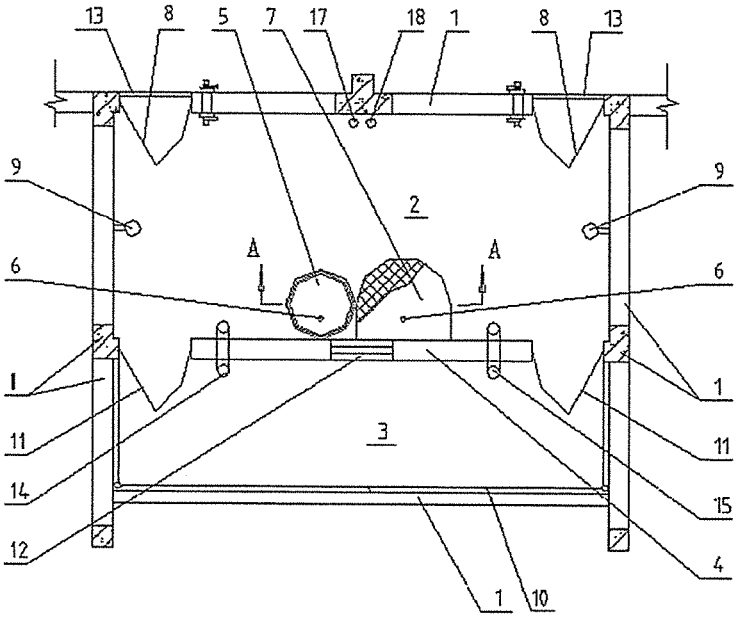
FIG. 5 is a schematic plan view of a preferred embodiment of a building fire refuge chamber according to the present invention.

FIG. 5 illustrates a plan view of a preferred embodiment of a building fire refuge chamber according to the present invention. The refuge chamber is an independent reinforced concrete structure integrated with the building, and in other embodiments, a steel structure can also be adopted, wherein the peripheral fire-proof wall 1 and the fire partition 4 located inside the refuge chamber which is defined thereby into a first space and a second space, the first space 2 being adjacent to the interior of the building and having a first fire door 8 leading to the interior space of the building enabling the first space to be communicated with the interior space of the building, and the first fire door 8 preferably corresponding to the evacuation exit of the building such that if a fire takes place, the individuals inside the building can quickly evacuate into the first space 2 of the refuge chamber through evacuation exit and the fire door 8. The second space 3 communicates with the exterior space of the building through the fire doors and windows etc. (not shown in Figures), whereas in this embodiment, at least a part of the second space is protruding to the outside of the outer wall of the building, so as to facilitate receiving external rescue such as aerial ladders. The fire partition 4 is provided with a second fire door 11. If the fire source comes from inside the building and the fire is strong, the individuals can retreat into the second space 3 through the second fire door 11 and meanwhile calling out for help and waiting for rescue. Further, the fire partition 4 is provided with an observation window 12, so that via which the escapers can first observe the situation in the second space 3 before entering, then enter the second space 3 after getting to know about the situation of the fire and making sure the fire source is not from outside the building. Moreover, the aforementioned first space 2 and second space 3 are both provided with an air supply pipe 14 and an air exhaust pipe 15 to avoid toxic smoke generated by the fire entering the refuge chamber resulting in casualties inside the chamber due to suffocating or poisoning.

Figure 6:
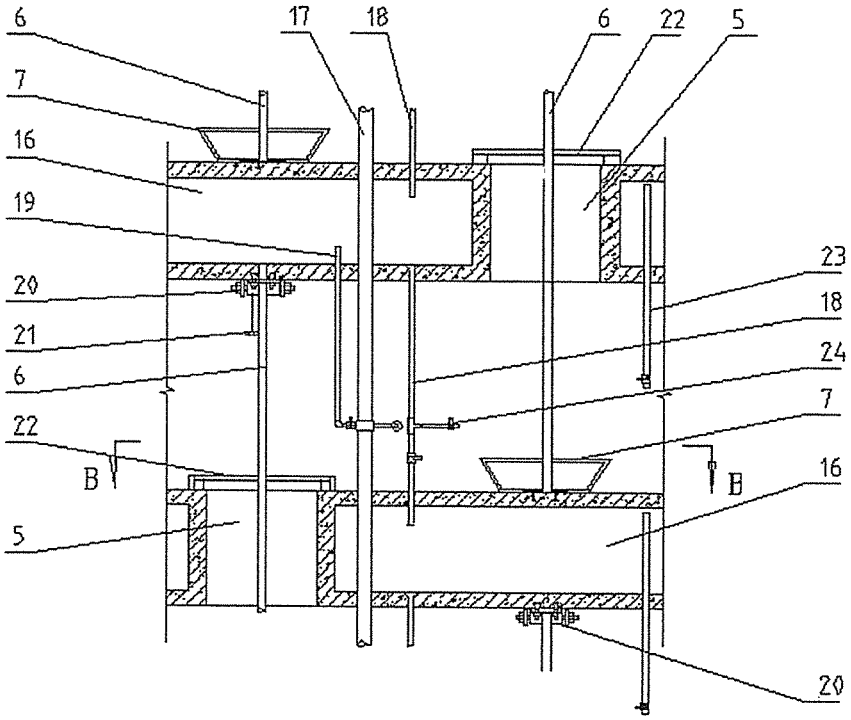
FIG. 6 is a sectional view taken along line A-A of FIG. 5.

As illustrated in FIG. 6, a water tank 16 can be provided on the top of the refuge chamber. The water inlet pipe 19 of the water tank 16 is connected to the fire main pipe 17 directly leading to the top floor of the building. The water outlet pipe 18 of the water tank 16 is connected at the bottom of the water tank 16 and has a gate valve, and is also provided with a hydrant 24 connected to a fire gun hose. The hydrant 24 can be connected to the fire gun when required, with the gate valve being opened in the meantime, to spray water to put out the fire. The water tank 16 can also be provided with an overflow pipe 23 to control the highest water level in the control box.

As illustrated in FIG. 5, further, a water curtain 13 with a gate valve may be provided above the first fire door 8, further isolating the fire and heat outside the door; the first space 2 may also be provided with drenchers 9 which can be turned on to put out the fire if the body of the person evacuating from the interior of the building into the first space 2 is with fire. The periphery of the refuge chamber floor may be provided with a drainage sink.

FIGS. 5 and 6 also illustrate another preferred embodiment of the building fire escape system provided in the present invention. As shown in FIG. 6, the system may include a plurality of the abovementioned refuge chambers, in which descending transferring points are provided, preferably each floor of the building being provided with such refuge chamber having same story height as that of the building, the floor surface thereof being equally leveled with the concrete floor surface of each floor of the building. An evacuation exit 5 leading to a lower refuge chamber and being covered with a fire-proof cover plate 22 in peacetime, is also provided in each refuge chamber. An auxiliary descending device is provided between two neighboring refuge chambers, for example, a sliding pole 6 and a cushion device 7 disposed at the lower end of the sliding pole 6.

As illustrated in FIG. 5, the evacuation exit 5, sliding pole 6 and cushion device 7 are preferably provided in the first space 2, so that if the individuals evacuated into the first space 2 of the refuge chamber observe via the observation window 12 and find out the fire source comes from outside the building and the fire already affects the second space 3, or come to realize the unavailability of external rescue from outside the building and having to evacuate on their own, they can open the fire-proof cover plate 22 and enter into the evacuation exit 5 to slide down along the sliding pole 6 to drop down on the cushion net 7 of the refuge chamber of the lower floor, so on and so forth until reaching the safe floor or the ground.

Furthermore, as illustrated in FIG. 6, the upper end of the sliding pole is provided with a safety rope 20 and a rope hook 21, so as to facilitate those who are inconvenient or unable to use the sliding pole 6 for descent, wherein the safety rope 20 is preferably self-winding steel wire safety rope.

Then as illustrated in FIG. 6, then, the water tank 16 of the refuge chamber on each floor has the water inlet pipe 19 respectively connected to the fire main pipe 17, and the water tank 16 of the refuge chamber on the upper floor can connect to the water tank 16 of the refuge chamber on the lower floor through the water outlet pipe 18.

Figure 7:
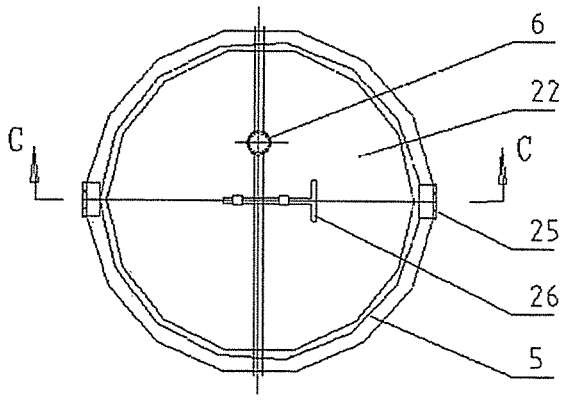
FIG. 7 is a schematic view of an embodiment of an evacuation exit.
Figure 8:
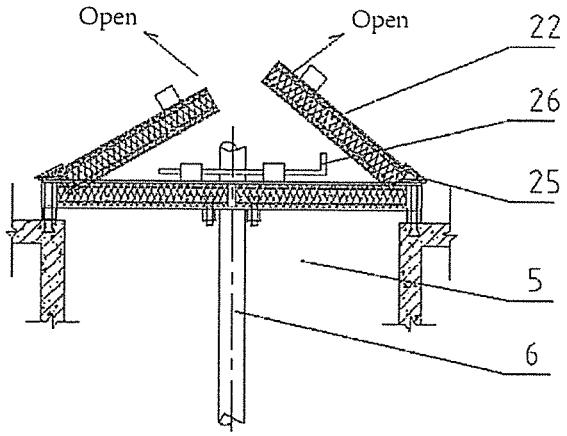
FIG. 8 is a cross sectional view of FIG. 7.

FIG. 7 illustrates a schematic view of an embodiment of the evacuation exit 5, wherein the fire-proof cover plate 22 consists of a two-leaf, upwardly flippable half round steel plate, mounted on the evacuation exit 5 by a hinge 25, the sliding pole 6 passing through the hole provided at the seam of the cover plate 22. When the two half round steel plates fold and close, they can be locked by a pin 26. FIG. 8 is a cross sectional view of FIG. 7.

Figure 9:
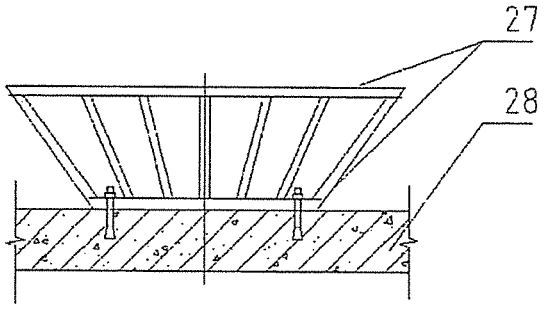
FIG. 9 is a structural schematic view of a safety net.
Figure 10:
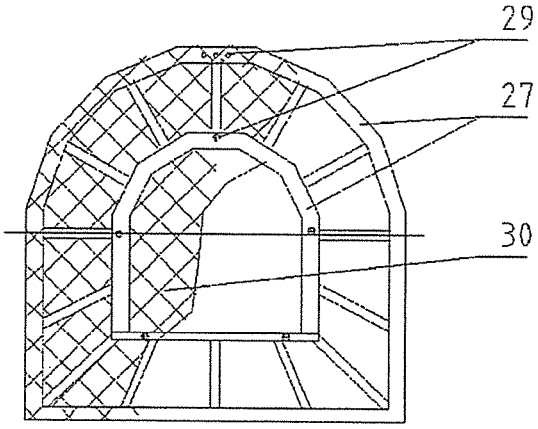
FIG. 10 is a top view of FIG. 9.

As illustrated in FIG. 9 and FIG. 10, the cushion device 7 is made up of a flared-shaped metal framework 27 on the concrete ground 28 of the refuge chamber on the lower floor and a metal wire mesh 30 affixed to the metal framework 27 through framework holes 29. The aforementioned metal framework 27 and metal wire mesh 30 are preferably of stainless steel. In other embodiments, the cushion device can also be other devices such as soft pad etc. that can provide cushion effect to protect the descending individuals.

The outer column board of the wall of the second space 3 facing the exterior space is painted by spray with white luminous coating to show the number of the corresponding floor. The escape sliding pole 6 is painted by spray with red and white reflective coatings, a section per 300 mm, all gate valves, fire-proof cover plate 22 and pin 26 being painted with red reflective coating, so as to facilitate the escapers to identify under poor lighting conditions.

At the first moment of a fire, indoor persons evacuate into the refuge chamber along the direction of the sign of the building evacuation exit corresponding to the first fire door 8 of the refuge chamber, in the following steps:

1. Turn off the indoor power supply and call 119 or 110 (911 in U.S.); immediately open the first fire door 8 of the entrance of the refuge chamber and the gate valve of the water curtain 13 on the door arch thereof, guiding people quickly entering the refuge chamber in order;

2. If body is with flames, immediately run to the drencher 9 of the first space 2 and turn on the shower head below the drencher to put out the fire;

3. Learn about the situation of the fire via the signal observation window, if the fire source is from inside the room, then quickly transfer to the second space 3 and shut the second fire door 11 of the refuge chamber thereafter. Meanwhile emergently enabling the fire-fighting equipment, and make self-rescue as putting out the fire, waving with a red flag during the day in combination with speakers or knocking drums for help, at night using red emergency lights or light sticks for help.

4. If the fire source is from outside the building, and the second space 3 is affected by the fire, persons should immediately transfer from the first space 2 using escape sliding pole 6 to slide downward. First, open the fire-proof cover plate 22 on the evacuation exit 5, children under 3 years of age are hold by adults to slide down, children of 4 years of age or above slide down under the guidance of adults, the inconvenient elderly should be assisted by healthy individuals with fastening the safety belt being hooked onto the rope hook 21 of the self-winding steel safety rope 20, then slide down along the escape sliding pole 6 to the next lower floor, so on and so forth until reaching a safe floor or the ground.

The refuge chamber is suitable for two or three at most families to use in the view of the plane layout, and is shared by multiple floors to use in the view of elevation layout. public buildings should be set up depending on the flow of people. The evacuation using the escape sliding pole 6 should be properly organized and cooperated, by first taking care of children, the elderly and women in an orderly evacuation.

Preferred embodiments of the present invention have been described above. It should be understood that many modifications and variations can be made by ordinary technician of the field according to conception of present invention without creative labor. Therefore, all the technical schemes obtained through logical analysis, deductions or limited experimentation based on the present invention by technicians of the field are within the scope of the claims.

The invention claimed is:

1. A building fire escape system comprising:

an auxiliary descending device, which can be used by evacuators to quickly descend from said building to evacuate if a fire takes place;

wherein further comprising at least one refuge chamber, said evacuators utilizing said auxiliary descending device to descend to said refuge chamber or to descend from said refuge chamber;

wherein said refuge chamber is a fireproof spatial structure integrated with said building, the interior of said refuge chamber is divided by a fire partition into a first space and a second space, said first space being communicated with the interior space of said building, said second space being communicated with the exterior space of said building, said fire partition is provided with a fire door connecting said first space with said second space, any two neighboring said refuge chambers are interconnected with each other.

2. A building fire escape system according to claim 1, wherein said first space is provided with a first fire door leading to the interior space of the building, a water curtain being provided above said first fire door.

3. A building fire escape system according to claim 1, wherein drencher devices are provided inside said first space.

4. A building fire escape system according to claim 1, wherein a water tank connected to a fire main pipe is provided on the top of said refuge chamber.

5. A building fire escape system according to claim 4, wherein said water tank is connected to a water outlet pipe having a gate valve, the water outlet pipe being provided with a hydrant connectable with a fire gun hose.

6. A building fire escape system according to claim 1, wherein said any neighboring said refuge chambers are interconnected with each other through an evacuation exit equipped with a fireproof cover plate.

7. A building fire escape system according to claim 6, wherein said fireproof cover plate is a two-leaf, upwardly flippable steel plate.

* * * * *